US008152478B2

(12) United States Patent
Zhou et al.

(10) Patent No.: US 8,152,478 B2
(45) Date of Patent: Apr. 10, 2012

(54) COMPRESSOR WITH CONTROLLED CAPACITY

(75) Inventors: Yi Zhou, Shanghai (CN); Yabing Tang, Shanghai (CN); Liang Xu, Shanghai (CN); Chunhui Liu, Shanghai (CN)

(73) Assignee: Shanghai Hitachi Electrical Appliances Co., Ltd., Pudong Jingqiao, Shanghai (CN)

( * ) Notice: Subject to any disclaimer, the term of this patent is extended or adjusted under 35 U.S.C. 154(b) by 0 days.

(21) Appl. No.: 11/997,552

(22) PCT Filed: Jul. 31, 2006

(86) PCT No.: PCT/CN2006/001916

§ 371 (c)(1),
(2), (4) Date: Jan. 31, 2008

(87) PCT Pub. No.: WO2007/014523

PCT Pub. Date: Feb. 8, 2007

(65) Prior Publication Data

US 2008/0226482 A1 Sep. 18, 2008

(30) Foreign Application Priority Data

Aug. 2, 2005 (CN) ..... 2005 1 0028382

(51) Int. Cl.
*F04B 23/04* (2006.01)

(52) U.S. Cl. ..... 417/62

(58) Field of Classification Search ..... 417/213, 417/212, 62; 137/625.43
See application file for complete search history.

(56) References Cited

U.S. PATENT DOCUMENTS

| | | | | |
|---|---|---|---|---|
| 4,966,194 | A * | 10/1990 | Nakatsukasa et al. | 137/625.43 |
| 4,976,286 | A * | 12/1990 | Holborow et al. | 137/625.43 |
| 5,042,521 | A * | 8/1991 | Shiomi | 137/118.07 |
| 5,178,543 | A * | 1/1993 | Semans et al. | 434/218 |
| 5,577,390 | A * | 11/1996 | Kaido et al. | 62/228.5 |
| 5,600,961 | A * | 2/1997 | Whipple, III | 62/175 |
| 7,213,405 | B2 * | 5/2007 | Shapiro | 62/228.3 |
| 7,409,833 | B2 * | 8/2008 | Unger et al. | 62/196.2 |
| 2003/0159739 | A1 * | 8/2003 | Hirota et al. | 137/625.43 |

* cited by examiner

*Primary Examiner* — Devon C Kramer
*Assistant Examiner* — Bryan Lettman
(74) *Attorney, Agent, or Firm* — Global IP Services; Tianhua Gu

(57) ABSTRACT

A double cylinder compressor with controlled capacity having a capacity switch device, and a reservoir having an inlet and two outlets which are connected with an upper and a lower cylinder of the double cylinder compressor through the capacity switch device. The capacity switch device being switched to realize the connection in series or in parallel for the cylinders of the double cylinder compressor, as a result, the discharge capacity of the compressor is that of the second stage cylinder when the connection in series, or the sum of the two cylinders when the connection is in parallel.

2 Claims, 3 Drawing Sheets

COMPRESSOR WITH CONTROLLED CAPACITY

CROSS REFERENCE TO RELATED PATENE APPLICATION

The application claims the priority of the Chinese patent application No. 200510028385.X with filing date of Aug. 2, 2005.

BACKGROUND OF THE INVENTION

1. Field of the Invention

The present invention relates to a rotatable compressor used for air conditioner, refrigerator and hot-pump type water heater, and more particularly to a compressor with controlled capacity and its capacity switch device.

2. Description of Related Art

The conventional compressor with controlled capacity is generally provided with openings in communication with intake and discharge chamber at single stage compressor cylinder or its upper or lower cylinder head, the open and cut-off of the openings is controlled by means of solenoid valve to realize the capacity control, also, there are two or more compressors connected in parallel to effect the capacity control. The capacity controlling way of this type is technically complex, less reliability and high overall cost.

SUMMARY OF THE INVENTION

The object of the present invention is to provide a compressor with controlled capacity, the flow of refrigerant gas in the double cylinder compressor is changed through a capacity switch device to realize the conversion between compression in series or in parallel of the double cylinders, as a result, the compressor outputs discharge capacity of one cylinder or two cylinders.

The another object of the present invention is to provide a 4way-2way solenoid valve suitable for the above mentioned compressor with controlled capacity, in order to simplify the structure and control of the said type compressor.

A compressor with controlled capacity in accordance with the invention mainly includes a double cylinder compressor with a reservoir, a capacity switch device, the outlet for the intake pipe of the said reservoir is divided into two branches, which are connected with the upper and lower cylinder through a capacity switch device switched between the 2way-2through and oneway-2through switch to realize the connection in series or in parallel for the double cylinder, as a result, the discharge capacity is the discharge capacity of the first stage cylinder when connection in series, or the sum of the two cylinders discharge when connection in parallel.

The capacity switch device has two input passages a and c and two output passages b and d, while in one work state, the input passage a is communicated with the output passage b, the input passage c is communicated with the output passage d; however in the other work state after switching, one passage between the input passage c and the output passage b or between the input passage a and the output passage d is blocked.

The special 4way-2way solenoid valve used in the compressor with controlled capacity in accordance with the invention has a pneumatic slide valve controlled by a solenoid valve, the said slide valve mainly includes a movable valve core controlled by a solenoid valve, a valve seat and two input passages and two output passages, the middle of the said valve core is a gas collection chamber which has 4 passages, one of which is an input passage a and the other three passages arranged equidistantly on the valve seat, the left and right one are output passage b, d, the middle one is another input passage c; the valve core drives a throttle bowl which can slide on the valve seat towards left or right, on the left or right position can cover the throttle bowl the left adjacent 2 passages b, c, or the right adjacent 2 passages c, d and make them in communication; at the same time the input passage a is communicated with the output passage d or c which is not covered by the throttle bowl, characterized in that the throttle bowl is provided with a bowl tongue on one side, when the throttle bowl is situated on one position and only on this position, the bowl tongue covers and blocks the output passage on the seat which is not covered by the throttle bowl.

The advantage of the present invention consists in that it may conveniently realize the conversion between two stage compressor and double cylinder compressor to complete the control of two discharge volume by making use of the said capacity switch device, particularly the special 4way-2way solenoid valve in connection with a double cylinder compressor in accordance with the present invention, this may not only reduce the manufacture cost but also simplify the fabrication process and reduce the installation space for the compressor, furthermore the control is very simple and reliable so that the market competence is raised significantly.

Figure 1:
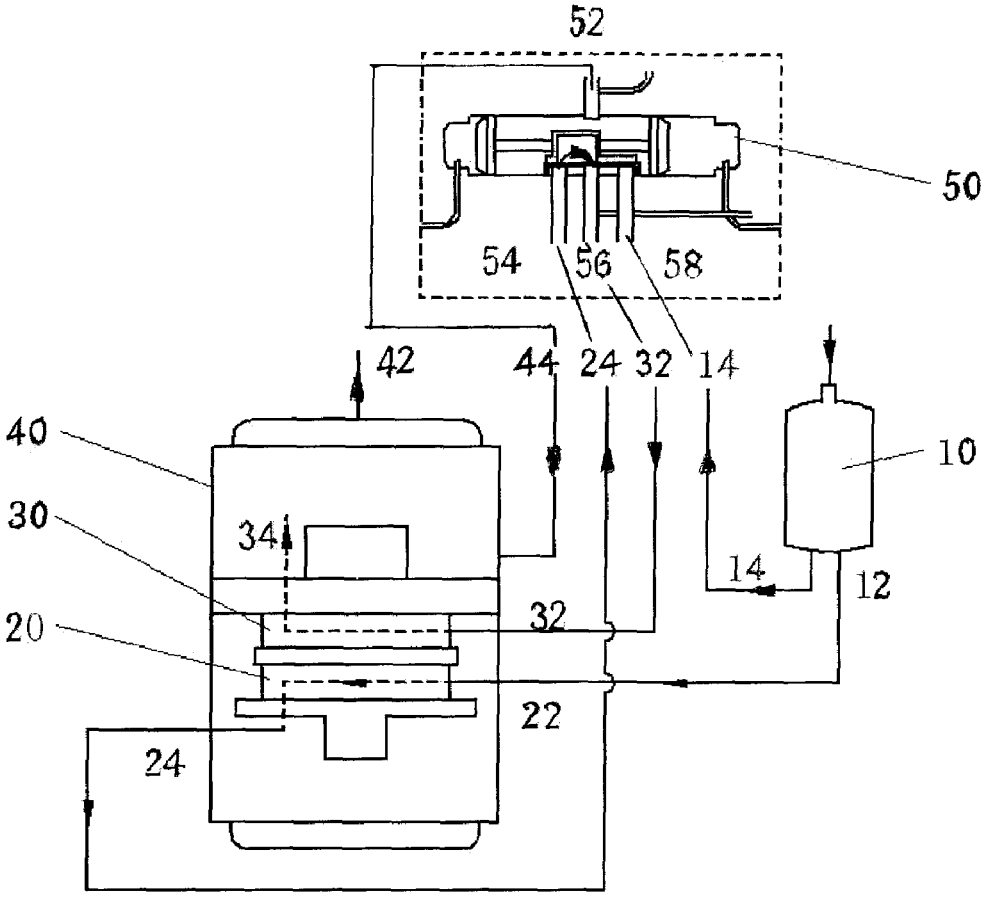
FIG. 1 is the structural diagram for the first embodiment of the present invention.

In the drawings there are shown the reservoir outlet 12,14, lower cylinder 20, intake inlet of the lower cylinder 22, discharge outlet of the lower cylinder 24, upper cylinder 30, intake inlet of the upper cylinder 32, discharge outlet of the upper cylinder 34, compressor casing 40, upper outlet of the casing 42, bypass of the casing 44, branch pipe 46, reversing valve 50, solenoid valve 51, input passage a 52, slide valve 53, valve core 532, gas collection chamber 534, valve seat 536, valve bowl 538, output passage b 54(unblocked), input passage c 56, output passage d 58(blocked), single way valve M and solenoid valve N.

DETAIL DESCRIPTION OF THE INVENTION

The present invention is described in more detailed with respect to several embodiments.

Embodiment 1

The present embodiment shows the connection form between a double cylinder compressor and the special 4way-2way reversing valve according to the invention as shown in FIG. 1. An outlet 12 of the reservoir 10 is connected with inlet 22 of the lower cylinder, the outlet 24 of the lower cylinder is connected with the unblocked output passage 54 of the reversing valve 50, the input passage 52 of the reversing valve is connected with the bypass 44 on the compressor casing; the another outlet 14 of the reservoir is connected with the output passage 58 of the reversing valve which may be blocked, the input passage 56 of the reversing valve is connected with the inlet 32 of the upper cylinder, the gas compressed by the upper cylinder will be discharged through the compressor upper outlet 42.

The work process is performed as follows: when the reversing valve is in the 2way-2through state, the fluid in one passage 12 of the reservoir enters the lower cylinder 20, the output of the lower cylinder 20 enters the bypass 44 on the compressor casing through the passage 54-52 of the reversing valve, the fluid in another passage 14 of the reservoir enters the upper cylinder 30 through the passage 58-56 of the reversing valve, the output of the upper cylinder 30 and the output of the lower cylinder 20 converge in the compressor casing, and discharged through the upper outlet 42 on the compressor casing. At this time the two cylinders are arranged in parallel, the discharge volume is the sum of the two cylinders' discharge amount.

When the reversing valve is in the oneway-2through state, the output of the lower cylinder 20 enters the upper cylinder 30 through the passage 54-56 of the reversing valve, the output of the upper cylinder 30 is discharged through the upper outlet 42 on the compressor casing, the fluid in another passage 14 of the reservoir is blocked at the output passage 58 of the reversing valve which may be blocked, at this time this passage is inactive.

This connection form is characterized in that when two cylinders are arranged in series, the discharged amount is that of the first stage cylinder, and the gas in the casing is the high pressure gas discharged from the second stage cylinder.

Embodiment 2

Figure 2:
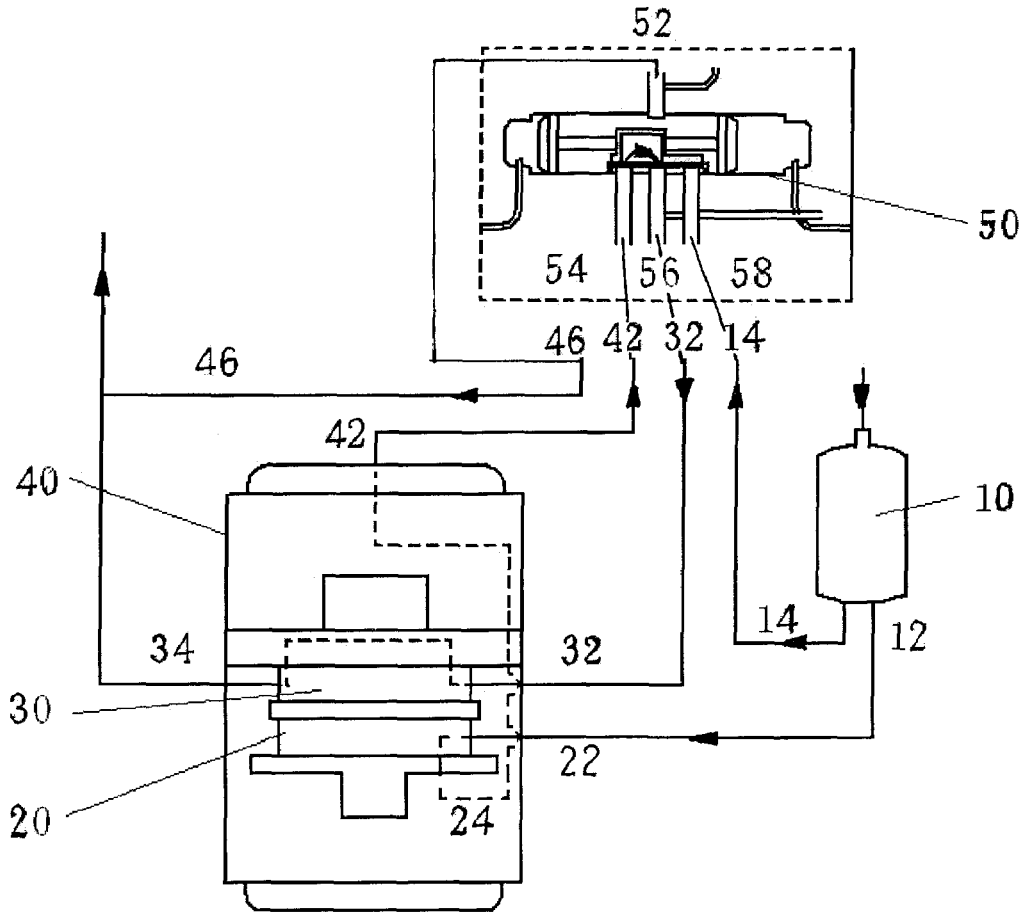
FIG. 2 is the structural diagram for the second embodiment of the present invention.

The present embodiment shows another connection form between a double cylinder compressor and the special 4way-2way reversing valve according to the invention as shown in FIG. 2. An outlet 12 of the reservoir 10 is connected with inlet 22 of the lower cylinder, the outlet 24 of the lower cylinder is discharged into the compressor casing and connected with the unblocked output passage 54 of the reversing valve through the upper outlet 42 on the compressor casing; the another outlet 14 of the reservoir is connected with the output passage 58 of the reversing valve which may be blocked, the input passage 56 of the reversing valve is connected with the inlet 32 of the upper cylinder, the output 34 of the upper cylinder is the output of the compressor, at the same time, connected with the input passage 52 of the reversing valve through a branch pipe 46 on the casing.

The work process is performed as follows: when the reversing valve is in the 2way-2through state, the fluid in one passage 12 of the reservoir enters the lower cylinder 20, the output 24 of the lower cylinder 20 is discharged into the compressor casing and enters the branch pipe 46 through the upper outlet 42 on the compressor casing and the passage 54-52 of the reversing valve, the fluid in another passage 14 of the reservoir enters the upper cylinder 30 through the passage 58-56 of the reversing valve, the output 34 of the upper cylinder 30 and the output of the lower cylinder 20 from the branch pipe converge as the compressor output. At this time the two cylinders are arranged in parallel, the discharge volume is the sum of the two cylinders' discharge amount.

When the reversing valve is in the oneway-2through state, the output 24 of the lower cylinder 20 is discharged into the compressor casing and enters the upper cylinder 30 through the upper outlet 42 and the passage 54-56 of the reversing valve, the output 34 of the upper cylinder 30 is discharged as the compressor output; the fluid in another passage 14 of the reservoir is blocked at the output passage 58 of the reversing valve which may be blocked, at this time the branch pipe 46 connected with the output 34 of the upper cylinder 30 is also blocked at the output passage 58 of the reversing valve which may be blocked. At this time the two cylinders are arranged in series, the discharge volume is that of the first stage cylinder.

This connection form is characterized in that when two cylinders are arranged and compressed in series, the middle pressure gas in the casing is discharged from the first stage cylinder, it is advantageous to reduce the pressure sustaining requirement of the casing and prevent the leakage of the refrigerant.

Embodiment 3

Figure 3:
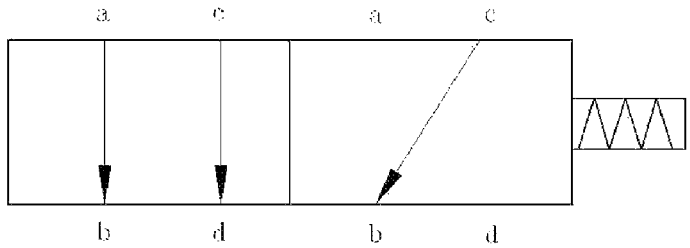
FIG. 3 is a sketch diagram of a capacity switch device which is switched between 2way-2through and 1way-2through.

The capacity switch device may be a 4way-2way reversing valve as shown in FIG. 3. The reversing valve has two input passages a and c and two output passages b and d, while in one work state, the input passage a is communicated with the output passage b, the input passage c is communicated with the output passage d; however in the other work state after switching, the input passage c is communicated with the output passage b, the input passage a and the output passage d are blocked.

Embodiment 4

Figure 5:
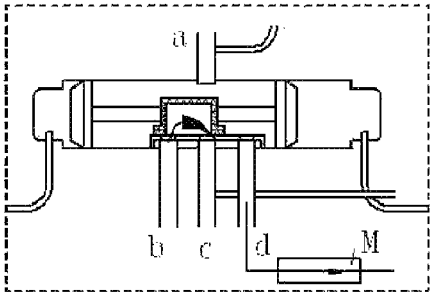
FIG. 5 is a sketch diagram of a capacity switch device consisted of a single way valve and a 4way valve.

Based on the work principle of the said capacity switch device as shown in FIG. 3, the device may consist of a single way valve M and a general 4way valve as shown in FIG. 5, the single way valve M is provided in one output passage of the general 4way valve in series, when gas flows from this output passage to the 4way valve, the flow is blocked so that one of the two passages is blocked as the 4way valve in one state.

Embodiment 5

Figure 6:
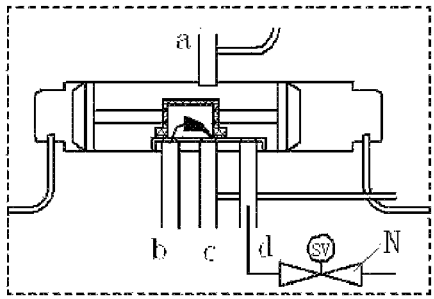
FIG. 6 is a sketch diagram of a capacity switch device consisted of a solenoid valve and a 4way valve.

Based on the work principle of the said capacity switch device as shown in FIG. 3, the device may consist of a solenoid valve N and a general 4way valve as shown in FIG. 6, the solenoid valve N is provided in one output passage of the general 4way valve in series. When the solenoid valve is switched on, the 4way valve is in 4way open state; when the solenoid valve is switched off, one of the two passages is blocked.

Embodiment 6

Figure 7:
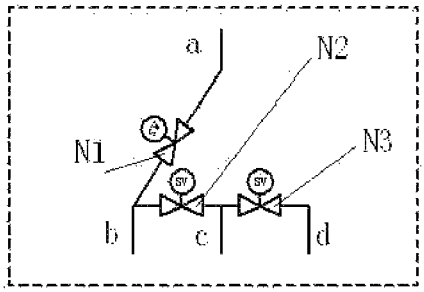
FIG. 7 is a sketch diagram of a capacity switch device consisted of three solenoid valves.

Based on the work principle of the said capacity switch device as shown in FIG. 3, the device may consist of three solenoid valves as shown in FIG. 7. The three solenoid valves N1,N2,N3 are provided in series in such way that the free end of N1 is input passage a, the connection point of N1 and N2 is output passage b, the connection point of N2 and N3 is another input passage c, the free end of N3 is another output passage d. When the solenoid valve N1 and N3 are switched on while N2 is switched off, the input passage a is in communication with the output passage b, and the input passage c is in communication with the output passage d; When the solenoid valve N1 and N3 are switched off while N2 is switched on, the input passage c is in communication with the output passage b, and the other passages are blocked. Therefore it is possible to realize the switch function for the capacity switch device by controlling each solenoid valve.

Embodiment 7

Figure 8:
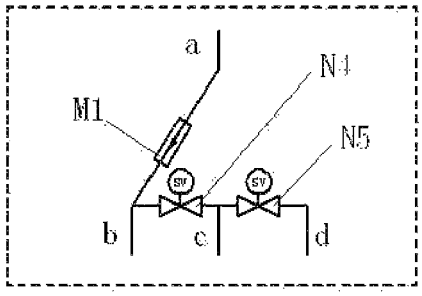
FIG. 8 is a sketch diagram of a capacity switch device consisted of a single way valve and a solenoid valve.

Based on the work principle of the said capacity switch device as shown in FIG. 3, the device may consist of a single way valve and two solenoid valves as shown in FIG. 8. One single way valve M1 and two solenoid valves N4, N5 are provided in series in such way that the one end of M1 is input passage a, the connection point of M1 and N4 is output passage b, the connection point of N4 and N5 is another input passage c, the other end of N5 is output passage d. When the solenoid valve N5 is switched on while N4 is switched off, the input passage a is in communication with the output passage b, and the input passage c is in communication with the output passage d; when the solenoid valve N4 is switched on while N5 is switched off, the input passage c is in communication with the output passage b, and the passage between the input passage c and the output passage d is blocked, and so the passage between b and a is also blocked conversely. Therefore it is possible to realize the switch function for the capacity switch device by controlling the solenoid valve N4 and N5.

Embodiment 8

Figure 4:
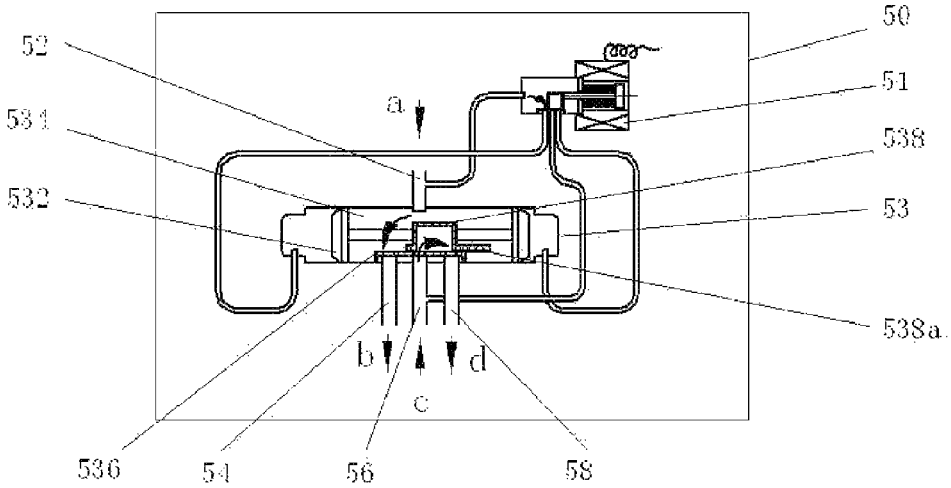
FIG. 4 is a sketch diagram of the special 4way-2way solenoid valve in accordance with the present invention.

One example of the special 4way-2way solenoid reversing valve used for the compressor with controlled capacity according to the present invention is shown in FIG. 4. In the valve casing there are a solenoid valve 51 and a pneumatic slide valve 53 controlled by this solenoid valve; the said slide valve 53 mainly includes a movable valve core 532 controlled by a solenoid valve, a valve seat 536 and two input passages and two output passages; the middle valve core is gas collection chamber 534 which has four passages, one of which is served as input passage 52, the other passages are equidistantly arranged on the valve seat 536, the left and right passage are two output passages 54 and 58, the middle one is another input passage 56; the said valve core 532 drives a bowl valve 538 which may slide in left or right direction on the seat 536, the bowl valve can cover the two adjacent passages 54 or 56 on the left side, or the two adjacent passages 56 or 58 on the right side of the valve seat 536 at left and right position respectively, and make them in communication; the said bowl valve 538 is provided with a bowl valve tongue 538*a* on the right side, when the bowl valve 538 is on the right side, the bowl valve 538 covers the two adjacent passages 56 and 58 on the right side of the valve seat 536, the bowl valve tongue 538*aa* is inactive; when the bowl valve 538 is on the left side, the bowl valve 538 covers the two adjacent passages 54 and 56 on the left side of the valve seat 536, the other output passage 58 is blocked by the bowl valve tongue 538*a*; one of the two output passages is blocked.

Evidently the bowl valve tongue 538*a* may be provided on the left side of the bowl valve 538 as well, at this point it is the output passage 54 on the left side of the valve seat 536 that is blocked, and the work principle is similar.

What is claimed is:

1. A double cylinder compressor with a controlled capacity comprising:

a compressor case having an outlet connection and a bypass passage connected externally thereto;

an upper cylinder and a lower cylinder sealed in the compressor case, the upper cylinder having an upper cylinder intake inlet and an upper cylinder discharge outlet, and the lower cylinder having a lower cylinder intake inlet and a lower cylinder discharge outlet;

a reservoir having an inlet, a first outlet and a second outlet; and a capacity switch device comprising a 4 way-2 way solenoid valve selectively in fluid communication with the intake inlets and discharge outlets of the upper cylinder and the lower cylinder, the outlet connection and bypass passage of the compressor case, and the inlet, the first outlet and the second outlet of the reservoir, wherein the capacity switch device has a first input passage (a), a second input passage (c), a first output passage (b) and a second output passage (d), wherein while the capacity switch device in a first work state, the first input passage (a) is in communication with the first output passage (b), and the second input passage (c) is in communication with the second output passage (d) such that in the first work state the first outlet of the reservoir is connected with the lower cylinder intake inlet, the lower cylinder discharge outlet is connected with the first output passage (b) which is in communication with the first input passage (a) which is connected to the bypass passage, the bypass passage being connected to an interior of the compressor case, the second outlet of the reservoir is connected with the second output passage (d) which is in communication with the second input passage (c) which is connected with the upper cylinder intake inlet, the upper cylinder discharge outlet in communication with the interior of the compressor case such that within the interior of the compressor case a gas compressed by the upper cylinder combines with a gas compressed by the lower cylinder and both compressed gases are discharged through the outlet connection of the compressor case, wherein while the capacity switch device is in a second work state, communication between the first input passage (a) and the second output passage (d) is blocked while the first outlet passage (b) is in communication with the second input passage (c), such that in the second work state the first outlet of the reservoir is connected with the lower cylinder intake inlet, the lower cylinder discharge outlet is connected with the first output passage (b) which is in communication with the second input passage (c) which is connected to the upper cylinder intake inlet, and the second outlet of the reservoir is connected with the second output passage (d) which is blocked from communication with the first input passage (a) which is connected to the bypass passage, the gas compressed by the lower cylinder being further compressed by the upper cylinder and discharged through the upper cylinder discharge outlet into the interior of the compressor case and passing through the outlet connection of the compressor case, wherein when the capacity switch device is working in the first work state the upper and lower cylinders are connected in parallel, a discharge of the compressor being a cumulative discharge from both the upper and the lower cylinders, wherein when the capacity switch device working is in the second work state, the upper and lower cylinders are connected in series, the discharge of the compressor being a discharge of the upper cylinder.

2. The double cylinder compressor according to claim 1, wherein the 4 way-2 way solenoid valve comprises a single solenoid valve or a solenoid valve and a general 4 way valve, the solenoid valve being provided in the second output passage (d) of the general 4 way valve to allow a flow therethrough when working in the first work state and to block the flow therethrough when working in the second work state.

* * * * *